US009027722B1

(12) United States Patent
Parker

(10) Patent No.: US 9,027,722 B1
(45) Date of Patent: May 12, 2015

(54) MOVABLE CONTAINER SYSTEM

(71) Applicant: William J. Parker, Chicago, IL (US)

(72) Inventor: William J. Parker, Chicago, IL (US)

( * ) Notice: Subject to any disclaimer, the term of this patent is extended or adjusted under 35 U.S.C. 154(b) by 0 days.

(21) Appl. No.: 14/193,350

(22) Filed: Feb. 28, 2014

Related U.S. Application Data

(60) Provisional application No. 61/790,134, filed on Mar. 15, 2013.

(51) Int. Cl.
*A45C 5/14* (2006.01)
*A45C 13/10* (2006.01)

(52) U.S. Cl.
CPC .. *A45C 5/14* (2013.01); *A45C 13/10* (2013.01)

(58) Field of Classification Search
CPC ..... A45C 13/10
USPC ..... 190/102, 108, 18 A
See application file for complete search history.

(56) References Cited

U.S. PATENT DOCUMENTS

| | | | | |
|---|---|---|---|---|
| 672,173 | A | 4/1901 | LeFevre | |
| 1,084,360 | A * | 1/1914 | Rahm | 190/108 |
| 2,581,417 | A | 1/1952 | Jones | |
| 4,836,343 | A * | 6/1989 | Arney | 190/108 |
| 5,099,968 | A * | 3/1992 | Kikuchi | 190/108 |
| 5,355,980 | A * | 10/1994 | Hsieh | 190/115 |
| 5,560,458 | A * | 10/1996 | Franklin et al. | 190/115 |
| 5,671,832 | A * | 9/1997 | London et al. | 190/108 |
| 5,829,559 | A * | 11/1998 | Nordstrom et al. | 190/102 |
| 5,927,450 | A | 7/1999 | Sadow | |
| 5,988,334 | A * | 11/1999 | Caruso | 190/18 A |
| 6,347,693 | B1 * | 2/2002 | Chen | 190/102 |
| 6,533,086 | B1 * | 3/2003 | Waddell et al. | 190/18 A |
| 6,536,568 | B1 * | 3/2003 | Tong | 190/101 |
| D516,869 | S | 3/2006 | Beal | |
| 7,322,477 | B2 * | 1/2008 | Schweitz | 206/579 |
| 7,322,585 | B2 * | 1/2008 | Handelman et al. | 280/47.26 |
| 7,503,569 | B2 * | 3/2009 | Duvigneau | 280/47.18 |
| 7,909,149 | B2 * | 3/2011 | Marji | 190/18 A |
| 8,087,513 | B2 * | 1/2012 | Kriesel | 206/314 |
| D671,316 | S * | 11/2012 | Kritzler | D3/279 |
| 2002/0144376 | A1 * | 10/2002 | Lee | 16/114.1 |
| 2004/0084269 | A1 * | 5/2004 | Wang | 190/108 |
| 2004/0173427 | A1 * | 9/2004 | Chernoff | 190/108 |
| 2004/0238241 | A1 | 12/2004 | Mitchell, Jr. | |
| 2005/0077136 | A1 * | 4/2005 | Brannin | 190/108 |
| 2005/0092568 | A1 * | 5/2005 | Nordstrom et al. | 190/115 |
| 2008/0308369 | A1 * | 12/2008 | Louis | 190/108 |

(Continued)

FOREIGN PATENT DOCUMENTS

FR 2865359 A1 * 7/2005

*Primary Examiner* — Sue A Weaver
(74) *Attorney, Agent, or Firm* — Donald J. Ersler

(57) ABSTRACT

A movable, e.g., wheeled, container, system, such as an article of luggage, cooler or other wheeled container, can include a container body with an openable lid. The system can include one or more wheels secured to the container body and a handle that extends from the container body. The system can include one or more strap mechanisms attached to the interior of the container body. Each strap mechanism can provide a retractable strap to extend from the container body. Each strap can be extended over an item to be secured to an exterior surface of the container body. An extended end of each strap can be secured to a fastening device located on an exterior surface of the container body. The wheels may be driven by motors that can be controlled by a user. A movable container system can be releasably attached to one or more other movable container systems.

17 Claims, 20 Drawing Sheets

(56) References Cited

U.S. PATENT DOCUMENTS

| | | | | |
|---|---|---|---|---|
| 2009/0095588 | A1 | 4/2009 | Thomas | |
| 2009/0101461 | A1* | 4/2009 | LaTowsky | 190/18 A |
| 2010/0059322 | A1* | 3/2010 | Reali | 190/108 |
| 2010/0170761 | A1* | 7/2010 | Herold | 190/18 A |
| 2010/0236886 | A1* | 9/2010 | Herold | 190/18 A |
| 2010/0270116 | A1* | 10/2010 | Wilson et al. | 190/102 |
| 2011/0168507 | A1* | 7/2011 | Penley et al. | 190/18 A |
| 2013/0037364 | A1* | 2/2013 | Ready | 190/18 A |
| 2013/0175129 | A1* | 7/2013 | Rankin et al. | 190/18 A |
| 2013/0213753 | A1* | 8/2013 | Salek | 190/18 A |
| 2013/0220754 | A1* | 8/2013 | Guidry | 190/18 A |

* cited by examiner

MOVABLE CONTAINER SYSTEM

CROSS-REFERENCES TO RELATED APPLICATIONS

This is a non-provisional patent application taking priority from provisional patent application No. 61/790,134 filed on Mar. 15, 2013.

BACKGROUND OF THE INVENTION

1. Field of the Invention

The disclosed subject matter is generally directed to movable containers for transporting objects or materials, and, in particular, to wheeled container systems, such as carry-on luggage.

2. Description of Related Art

Movable, e.g., wheeled container systems are known Such containers can typically include a substantially rectilinear storage case that can be provided with wheels along one lower side and a retractable handle that can be extended for towing the case, or retracted for storage within the case.

U.S. Pat. No. 672,173 to LeFevre discloses a package holder. U.S. Pat. No. 2,581,417 to Jones discloses a luggage carrier having projectable and retractable supporting rollers. U.S. Pat. No. 5,927,450 to Sadow discloses an auxiliary luggage holder with external pocket for auxiliary securement strap. Patent publication no. 2004/0238241 to Mitchell, Jr. discloses a front wheel motor driven-golf trolley. U.S. Pat. No. D516,869 to Beal discloses a mobile insulated receptacle. Patent publication no. 2009/0095588 to Thomas discloses an article securement system.

Typically, a person using such a case, which may be a piece of wheeled carry-on luggage, will also be carrying a briefcase, bag or similar article, such as knapsacks and duffle bags, any of which may have interior or exterior frames or not have any frames. The wheeled luggage may be provided with a strap that is secured to the wheeled case at a location adjacent to the top front edge of the case, i.e., at a position remote from the towing handle. That strap can be attached directly to the extra article to be carried, if the extra article is configured correctly, or can be passed through a handle of the extra article, again if configured correctly, and then be secured to an eyelet on the wheeled carry-on case. In some known systems, the extra article is loosely positioned frontally of the wheeled case. If the extra article or the luggage itself is sufficiently heavy, this situation can cause the wheeled case to fall if the wheeled case is left unattended in a standing position or the article being carried becomes unsecure or falls off. What is needed is an easy and efficient way to store, carry, and otherwise accommodate additional items that must be carried after a piece of luggage or similar container is already packed. An example of these additional items can include clothing, such as coats and sweaters, purses, child-related items, such as a diaper bag, food items, such as water bottles and bagged food, books, newspapers and magazines, other suitcases of briefcases, laptop and tablet computers, and cameras and camera equipment.

SUMMARY OF THE INVENTION

The disclosed subject matter provides a movable container system, such as a wheeled article of luggage that can include a container body having exterior surfaces configured to enclose an interior space of the container body. At least one of the exterior surfaces can be operable, e.g., a lid, to allow access to the interior space of the container body. The system can include one or more wheels secured to the container body and a handle configured to extend from the container body. The system can include one or more strap or cord mechanisms attached to an interior surface of the container body. Each strap mechanism can provide a retractable strap or cord, hereinafter referred to as a strap, configured to extend from the interior of the container body. Each strap can be configured to be extended over an item to be secured to an exterior surface of the container body. An extended end of each strap can be configured to be secured to a fastening device located on an exterior surface of the container body.

In an embodiment, a movable container system can include a container body having exterior surfaces configured to enclose an interior space of the container body, wherein at least one of the exterior surfaces is openable to allow access to the interior space of the container body. The system can further include one or more wheels secured to the container body, a handle configured to extend from the container body and one or more strap mechanisms attached to an interior surface of the container body, wherein each strap mechanism provides a retractable strap configured to extend from the interior of the container body. Each retractable strap can be configured to be extended over an item to be secured to an exterior surface of the container body. An extended end of each retractable strap can be configured to be secured to a fastening device located on an exterior surface of the container body.

In an embodiment the container system can be an item of luggage.

In an embodiment the container system can be a food cooler, brief case, duffle bag, backpack, book bag or the like.

In an embodiment, the fastening device can be attached to a nonopenable surface of the container body.

In an embodiment, a locking mechanism operable from the exterior of the container body can be configured to keep each strap at a desired length.

In an embodiment, a tensioning mechanism can be configured to adjust the tension in each strap.

In an embodiment, a motorized movable container system can include a container body having exterior surfaces configured to enclose an interior space of the container body, wherein at least one of the exterior surfaces is openable to allow access to the interior space of the container body. The system can further include one or more wheels secured to the container body, a handle configured to extend from the container body and one or more strap mechanisms attached to an interior surface of the container body, wherein each strap mechanism provides a retractable strap configured to extend from the interior of the container body. Each strap can be configured to be extended over an item to be secured to an exterior surface of the container body. An extended end of each strap can be configured to be secured to a fastening device located on an exterior surface of the container body. The system can further include a motor, which can be operatively connected to the wheels and a motor controller.

In an embodiment, the motorized movable container can be an item of luggage.

In an embodiment, the container system can be a food cooler duffle bag, backpack, book bag or the like.

In an embodiment, the fastening device can be attached to a non-openable surface of the motorized movable container system body.

In an embodiment, a locking mechanism operable from the exterior of the motorized movable container system body can be configured to keep each strap at a desired length.

In an embodiment, a tensioning mechanism can be configured to adjust the tension in each strap of the motorized movable container.

In an embodiment, the motor can be battery powered.

In an embodiment, the motor can be operatively connected to the wheels using a clutch mechanism.

In an embodiment, the motor controller can be located in the handle.

In an embodiment, the motor controller can be configured to allow motor speed to be variably adjusted.

BRIEF DESCRIPTION OF THE DRAWINGS

As will be realized, different embodiments are possible, and the details disclosed herein are capable of modification in various respects, all without departing from the scope of the claims. Accordingly, the drawings and descriptions are to be regarded as illustrative in nature and not as restrictive. Like reference numerals or characters are used throughout the several views and embodiments to designate like components.

DETAILED DESCRIPTION OF THE PREFERRED EMBODIMENTS

To facilitate an understanding of the principles upon which the subject matter disclosed herein is based, most illustrative embodiments are described hereinafter with reference to their implementation as wheeled luggage and other wheeled containers. It will be appreciated that the practical applications of these principles are not limited to this particular type of implementation rather, they can be equally employed in other suitable container system operating environments.

Figure 1A:
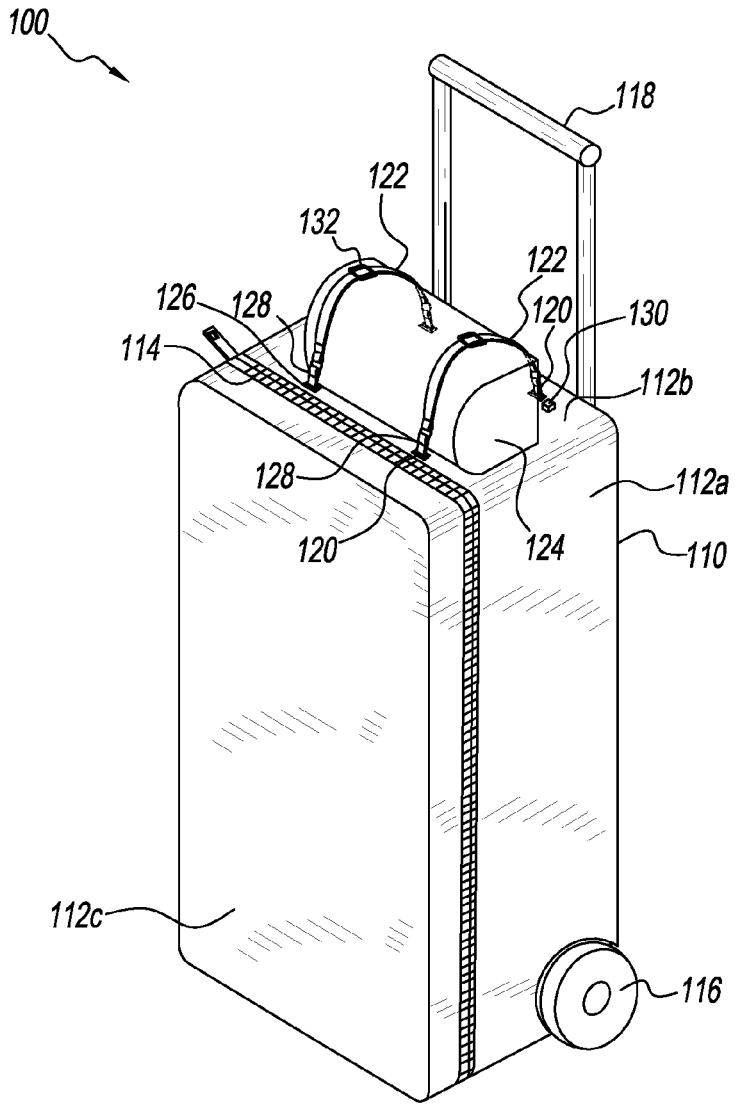
FIG. 1A is a perspective view of an illustrative embodiment of a movable container system configured as a wheeled article of luggage.

FIG. 1*a* shows an illustrative embodiment of movable container system 100 configured as a wheeled article of luggage, such as wheeled carry-on bag or similar item of luggage. In an embodiment container system 100 can include container body 110 having exterior surfaces 112, e.g., 112*a*, 112*b*, 112*c*, etc., configured to enclose an interior space (not shown) of the container body 110. In an embodiment, at least one of the exterior surfaces 112, e.g., 112*c* can be openable to allow access to the interior space of the container body 110. In an embodiment openable surface 112*c* may be secured to container body 110 using any suitable closure device, such as a zipper 114, for example. Other suitable closure and securing devices such as latches can be used. In an embodiment, when container system 100 is wheeled, its major dimension can be oriented in a generally vertical direction.

In an embodiment, the container body 110 can be made from materials of suitable characteristics that can include natural fabrics such, as cotton, as well as cordura, leather, ballistic nylon, aluminum, polyester, polypropylene, ABS and polycarbonate to name just a few non-limiting examples. Other suitable materials for wheeled luggage and other containers will be known by those of skill in the art.

In an embodiment, one or more wheels 116 can be secured to container body 110. In an embodiment, wheels 116 can be arranged in what is known as a "spinner bag" arrangement. For example, a spinner bag can include four rotating castors on the bottom of the bag. The bag can be towed behind in a diagonal position or pushed in an upright position. The bag can also be rotated and maneuvered easily in tight spaces. In an embodiment, wheels 116 can be locked to prevent rotating to prevent system 100 from moving, e.g., as a security measure. In an embodiment, the wheels can be locked and unlocked using, e.g., a key lock, combination lock or similar locking device that can be activated remotely from the wheels, such as on the handle or body of the case. In an embodiment, the wheels can be locked using a pedal-like device, for example, located at or near the base of the container body near the wheels that can lock the wheels and prevent movement. In an embodiment, the pedal mechanism can be unlocked remotely and then used to unlock the wheels.

In an embodiment, handle 118 can be configured to extend from container body 110. In an embodiment, the handle 118 can be retracted into container body 110, or can be extended therefrom, e.g., a telescoping handle, to permit towing of container system 100 by angling the container body 110 into ground engagement of wheels 116. In an embodiment, handle 118 can substantially resemble a "T" shape.

In an embodiment, handle 118 can be designed to be extended and retracted, i.e., telescoped, and also have the ability to tilt. For example, handle 118 can be extended to a pre-determined location and then tilted. In an embodiment, once handle 118 is tilted it can be locked into the tilted position. This can be useful when it is desired to pull a container system while maintaining it at a substantially level orientation, such as when pulling another container system that is releasably attached to a first container system.

In an embodiment, one or more strap mechanisms 120 can be attached to an interior surface of container body 110 or to a suitable support structure member or frame component inside container body 110. In an embodiment strap mechanism 120 can be a retractable, spring-powered, reel-type device that can be provided with a retractable strap 122, which can be configured to extend from strap mechanism 120 inside container body 110 and be extended over an item 124 to be secured to an exterior surface 112. e.g., the top, of container body 110. Other suitable devices that can provide for extending and retracting a strap can be used. In an embodiment retractable straps 122 can be made of, e.g., nylon, polyester or other suitable materials and may be as elastic or inelastic as desired.

In an embodiment, an extended end 128 of retractable strap 122 can be configured to be secured to a fastening device 126, e.g., located on or inside of an exterior surface 112 of container body 110. With reference to FIGS. 1E-1I, the extended end 128 of retractable strap 122 can include an open hook 210, a hook with a depressible closure 212, a hook with a retractable closure 214, a loop 216, a buckle 218, hook and loop fastener system, e.g., VELCRO, connector, or similar device to name a few non-limiting examples. With reference to FIGS. 1J-1O the fastening device 126 can be the open hook 210, the hook with a depressible closure 212, the hook with a retractable closure 214, the loop 216, a bar 220, a buckle 218, a retractable bar, cleat, shackle or similar device, to name a few non-limiting examples, on or inside of an exterior surface 112 of container body 110 and configured to receive and secure extended end 128 of retractable strap 122. In an embodiment, there can be a fastening device 126 for each retractable strap 122. In an embodiment there can be fewer fastening devices 126 for each retractable strap 122, e.g., more than one retractable strap 122 can be secured to a fastening device 126.

In an embodiment, fastening device 126 can be attached to a non-openable surfaces e.g, 112*b* of container body 110. In an embodiment, this configuration can allow for access to the interior of container body 110, i.e., openable surface 112*c* can be free to open and close when retractable straps 122 are in use and extended over item 124 and secured to a fastening device 126 on container body 110. In an embodiment, extended end 128 of retractable strap 122 can be secured to a fastening device 126, such as a bar, cleat, shackle or similar device on or inside of an exterior surface 112 exterior of container body 110.

Figure 1B:
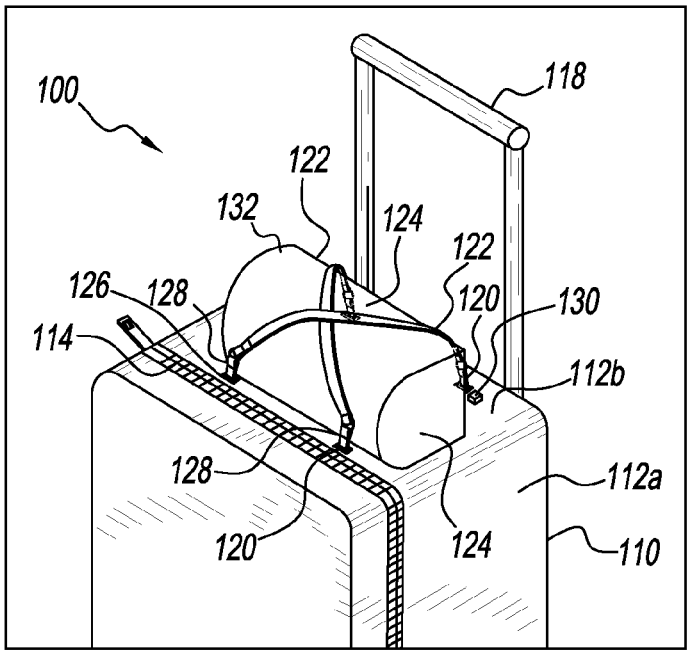
FIG. 1B is a partial perspective view of an illustrative embodiment of a movable container system configured as a wheeled article of luggage with two retractable straps crossed.
Figure 1C:
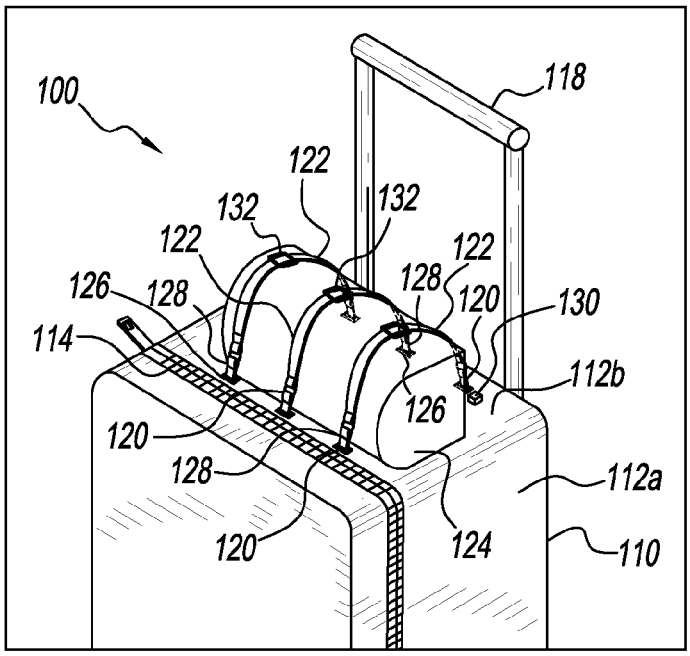
FIG. 1C is a partial perspective view of an illustrative embodiment of a movable container system configured as a wheeled article of luggage with three retractable straps.

With reference to FIG. 1C, the container system 100 can include one or more strap locking mechanisms 130 operable from outside container body 110 that can be configured to engage and keep retractable strap 122 at a desired length. In an embodiment, strap locking mechanism 130 can be located as part of strap mechanism 120, e.g., a device that locks a reel containing a retractable strap 122 and can be controlled from outside of container body 110, using, e.g., a button or latch, or may be located at another suitable location where a strap locking mechanism 130 can prevent movement of a retractable strap 122 when engaged.

In an embodiment retractable strap 122 can include a tensioning mechanism 132 configured to adjust tension in retractable strap 122. In an embodiment, tensioning mechanism 132 can be a slidable buckle, for example, or any other suitable device that can be used to adjust tension in retractable strap 122. For example, retractable strap 122 can be tightened to provide greater security to the article being carried.

In an embodiment, in operation, retractable strap 122 may be secured using an insert and receiver type mechanism, similar to that used with seat belts. In an embodiment, a retractable strap 122 can be extended, e.g., pulled out, from a strap mechanism 120, over an item 124 to be secured to an exterior surface 112 of the container body 110. In an embodiment, more than one retractable strap 122 can be extended in parallel over item 124, or can be crossed over item 124, depending on the characteristics of item 124 and the needs of the user. In an embodiment, retractable strap 122 can be fastened at extended end 128, e.g., hooked, buckled, etc., to fastening device 126, which can be a hook, loop, buckle, hook and loop fastener system, e.g, VELCRO, etc. In an embodiment, retractable strap 122 can then be locked at a desired length, using strap locking mechanism 130. Further adjustments to tension in the retractable strap 122 can be accomplished using tensioning mechanism 132, e.g., a slide tensioner or similar device.

Figure 1D:
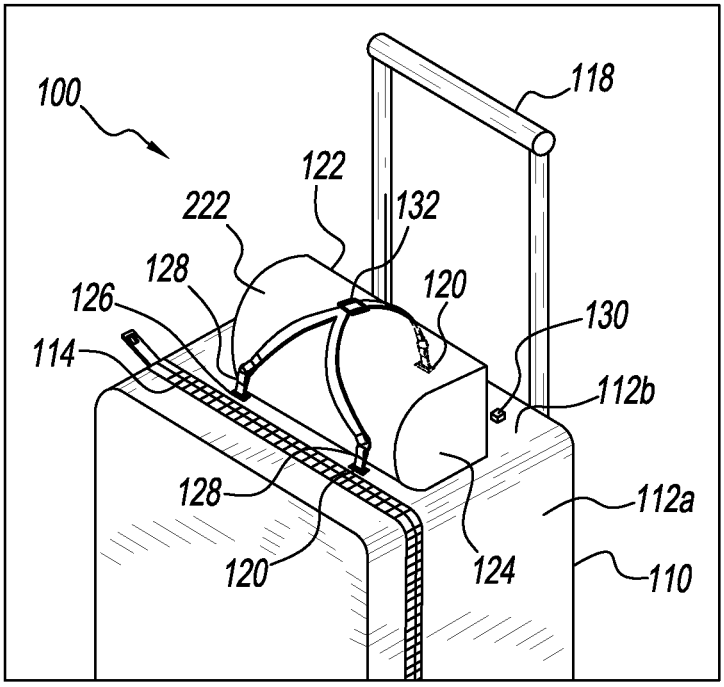
FIG. 1D is a partial perspective view of an illustrative embodiment of a movable container system configured as a wheeled article of luggage with a Y-shaped retractable strap.
Figure 1E:
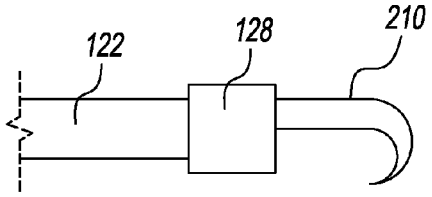
FIG. 1E is a side view of an extended end with an open hook of a movable container system.
Figure 1F:
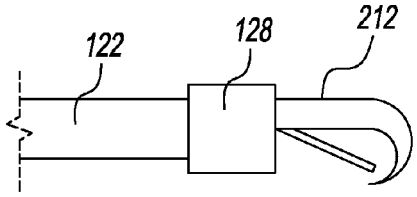
FIG. 1F is a side view of an extended end with a hook having a depressible closure of a movable container system.
Figure 1G:
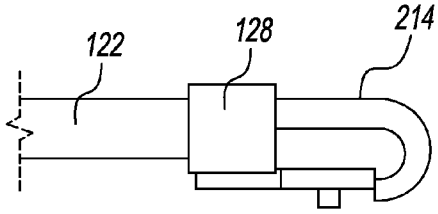
FIG. 1G is a side view of an extended end with a hook having a retractable closure of a movable container system.
Figure 1H:
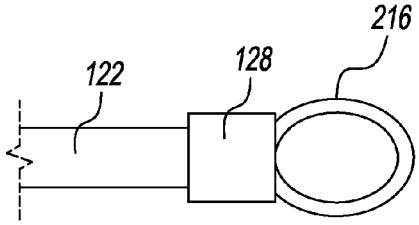
FIG. 1H is a side view of an extended end with a loop of a movable container system.
Figure 1I:
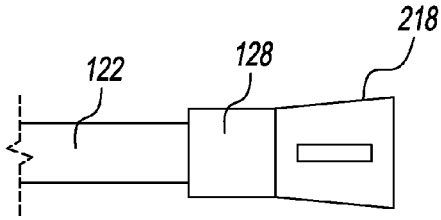
FIG. 1I is a side view of an extended end with a buckle of a movable container system.
Figure 1J:
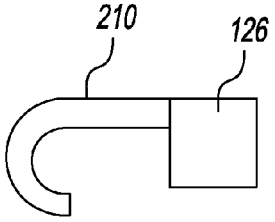
FIG. 1J is a side view of a fastening device with an open hook of a movable container system.
Figure 1K:
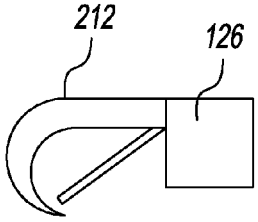
FIG. 1K is a side view of a fastening device with a hook having a depressible closure of a movable container system.
Figure 1L:
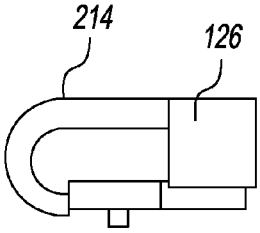
FIG. 1L is a side view of a fastening device with a hook having a retractable closure of a movable container system.
Figure 1M:
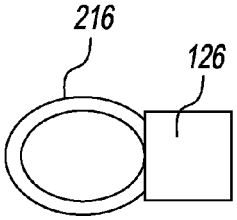
FIG. 1M is a side view of a fastening device with a loop of a movable container system.
Figure 1N:
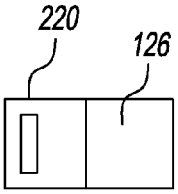
FIG. 1N is a side view of a fastening device with a bar of a movable container system.
Figure 1O:
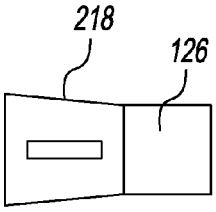
FIG. 1O is a side view of a fastening device with a buckle of a movable container system.

With reference to FIG. 1D, there can be a single retractable strap 222 substantially in the shape of a "Y" or "V". For example, a portion of the strap can be a single strap operatively connected to a strap mechanism 120. At a desired length along the strap, it can split into two or more sections. At an extended end of each section there can be can be an attachment device as described previously, e.g., an open hook, a hook with a depressible closure, a hook with a retractable closure, ring, loop, buckle, hook and loop fastener system, e.g., VELCRO, or similar device to name a few non-limiting examples. Each extended end can be fastened and adjusted as described above. Similarly, the strap can be locked and adjusted as described above.

In an embodiment, one or more strap mechanisms 120 and one or more fastening devices 126 can be placed in an alternating arrangement. In an embodiment, for example, two strap mechanisms 120 can be located closer to the rear wall of container body 110 while another strap mechanism 120 can be placed closer to the front side or lid 112*c* of container body 110. With reference to FIG. 1B, two straps 224 could be extended from the rear to the front, fastened, locked and adjusted, while the other strap would be extended from the front to the rear and fastened, locked and adjusted. Such a system can provide for a reverse-tension or opposite pull effect that can add greater security to the article to be carried.

Figure 2:
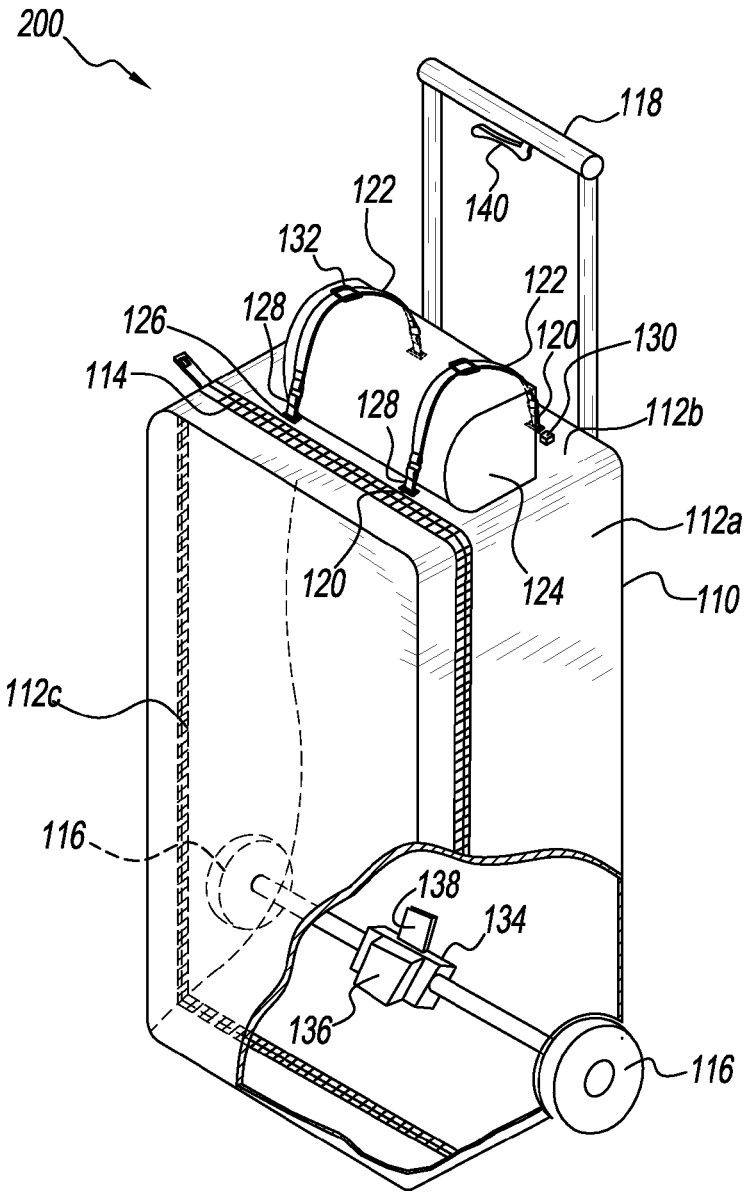
FIG. 2 is a perspective view of an illustrative embodiment of a motorized container system configured as a wheeled article of luggage.

FIG. 2 shows an illustrative embodiment of container system 200 configured as a wheeled article of luggage where motor 134 can be used to provide power to each wheel 116. In an embodiment, there can be one motor used to power all wheels or there can be more than one motor, e.g., each wheel can have its own motor. In an embodiment, the structure and components may be substantially the same as shown in FIG. 1.

In an embodiment, motor 134 can be a battery-powered electric motor located in container body 110. Persons of skill in the art will know how to select motors based on desired payload capacity and other desired operational characteristics. In an embodiment, motor 134 can be operatively connected to the wheels using a clutch mechanism 136. In an embodiment, clutch mechanism 136 can be used to allow full manual operation (wheel disengaged from the motor) to save battery life or when motorized operation isn't necessary. In an embodiment, clutch mechanism 136 can be used to allow powered operation (wheels engaged with the motors). In an embodiment, with battery 138 removed, no gearing or transmission is necessary for wheels 116 to operate.

In an embodiment, battery 138 can be configured as unit of a suitable number of Nimh or lithium rechargeable batteries and can include a battery management system built into the unit of batteries. Other suitable portable electric rechargeable power sources can be used. In an embodiment, the battery 138 can be located in container body 110. In an embodiment, the battery 138 can be configured to be accessible in a separate part of container body 110 such that battery 138 can be inserted or removed from container body 110 without having to open a main part of container body 110, e.g., there can be a separate battery compartment with its own access cover. In an embodiment, battery 138 can be configured to be charged, while in container body 110 or removed for charging. In an embodiment, a detachable cord can be provided to charge battery 138. In an embodiment, a charging cord can be stored in a recess in container body 110.

In an embodiment, there can be a battery power meter indicative of the state of charge of the battery 138. Such a battery power meter can be visible to an operator, e.g, located on an exterior surface of container body 110 or on the handle 118. In an embodiment, a battery power meter can be a meter, one or more lights or an audio alarm that can signal the state of charge of battery 138.

In an embodiment, a power generation mode can be provided such that the battery 138 can be recharged when the case is moving without power being required, e.g., downhill or on some flat smooth surfaces. In an embodiment, motor controller 140 can be located in or near handle 118.

In an embodiment, motor controller 140 can be configured to allow motor speed to be variably adjusted. In an embodiment, motor controller 140 can be an on-off switch, which can also control motor speed, e.g., motor speed can be variable between off and on. In an embodiment, motor controller 140 can be operated as a twist-grip, a button, a lever or bar pushed to engage, or a control cable or any other suitable speed control device. In an embodiment, motor speed or torque can be controlled entirely by an operator using manual methods, e.g., adjusting a switch being used as motor controller 140, or by automatic methods, e.g., sensors determining optimum torque and controlling the motor automatically, or by a combination of both. In an embodiment, a safety feature can be provided such that when an operator releases the motor controller 140, the motor 134 automatically stops.

In an embodiment, the position of handle 118 can also play a role in the motor control circuitry. For example, handle 118 can be required to be fully extended or placed at a particular angle for a complete circuit to exist that would allow motor 134 to be operational. In an embodiment, this can be accomplished by having electrical contacts at different positions in the structure that contains part of handle 118, to name a non-limiting example. Such a feature may be desirable, for example, when checking luggage onto an airplane. For example) with handle 118 inserted, the motor control circuit or battery could be disconnected, which could prevent accidental activation of the motor 134. A latch or similar device can be provided to ensure that handle 118 does not accidentally open while in transit.

In an embodiment, as an added safety measure, tilt sensors can be used so that power will not be provided to the motors when the case is stationary, upright, or if it falls to the floor. In an illustrative embodiment, when a user engages handle 118, i.e., pulls it out to a predetermined position, a red LED light can be illuminated to indicate that the system is active and the battery has sufficient charge. A manual override button can also be provided that allows the user to turn the system off when the handle is engaged.

In an embodiment, within handle 118 pressure sensors can monitor how hard the user is pulling container system 100 and provide a signal to the motor control circuitry to provide a predetermined amount of torque to the wheels to compensate.

In an embodiment, a security device, such as a cord or wire of suitable material, can be provided to secure container system 110 in place. Such a cord or wire can be secured on one end on a retractable mechanism placed on or inside of container body 110. In an embodiment, the cord or wire can be withdrawn, wrapped around a suitable structure such as a post and secured, e.g., locked using a keyed or combination lock to a fastening device on container body 110.

Figure 3A:
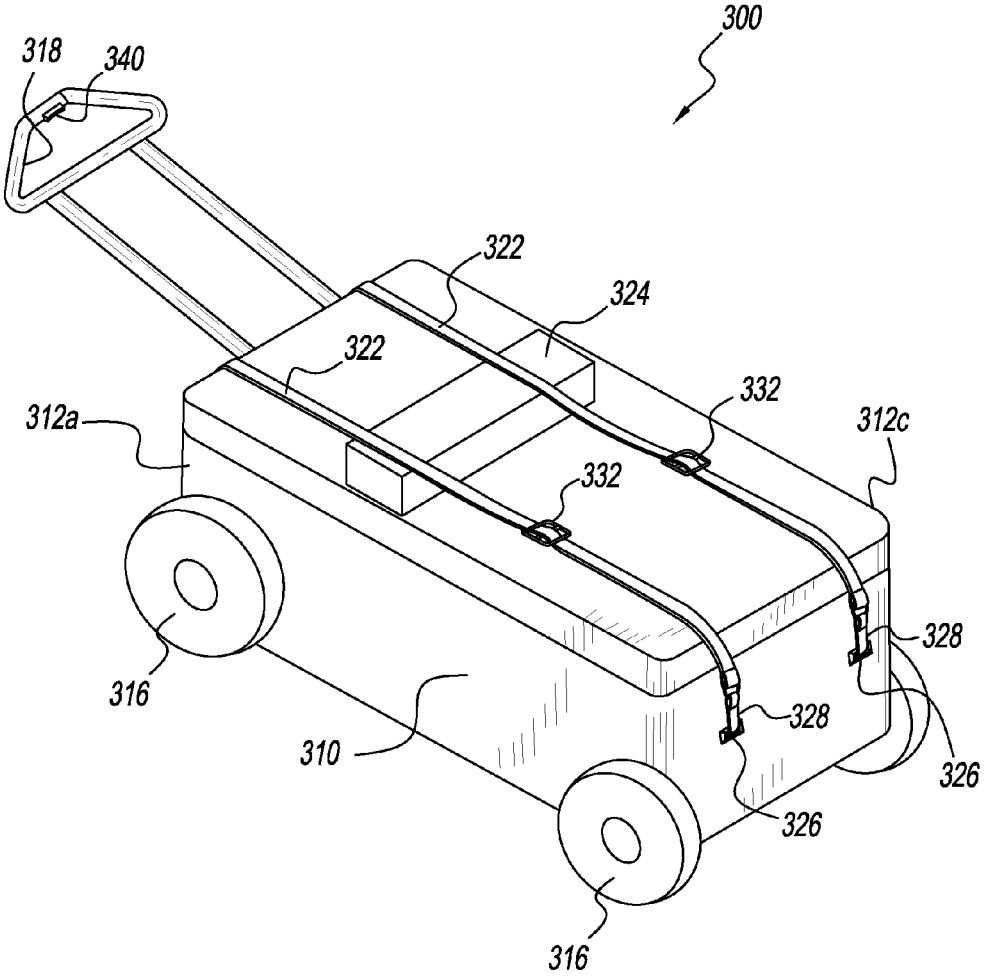
FIG. 3A is perspective view of an embodiment of a movable container system configured as a wheeled food cooler.
Figure 3B:
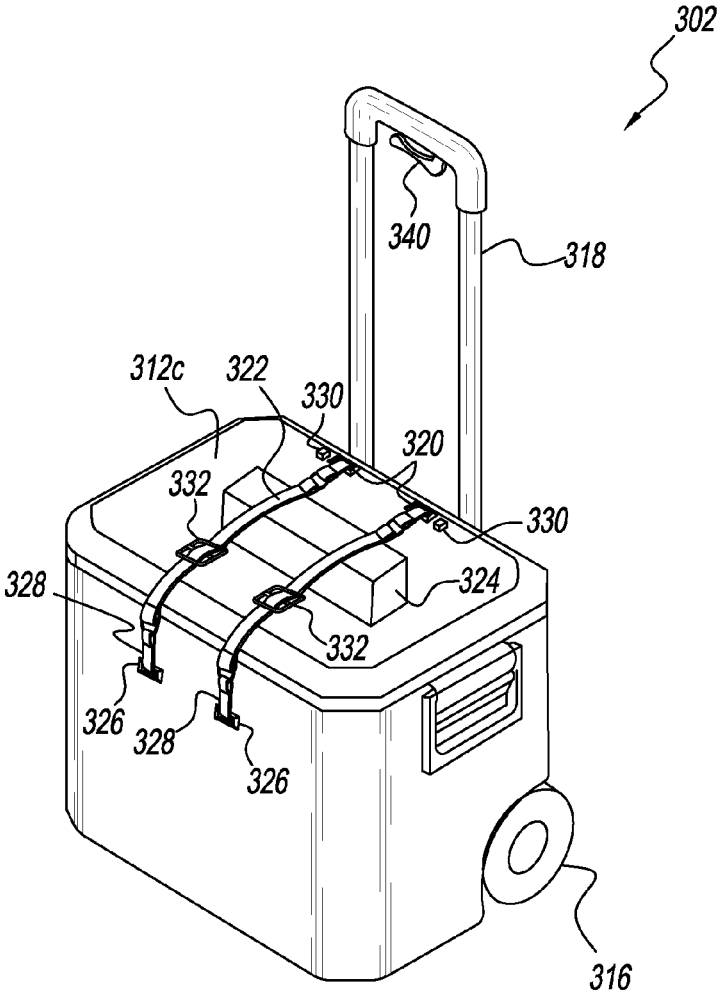
FIG. 3B is a perspective view of a second embodiment of a movable container system configured as a wheeled food cooler.

The abovementioned features can be incorporated beyond their use in wheeled luggage. With reference to FIG. 3A, a movable container system is configured as a wheeled food container 300. FIG. 3B shows a second embodiment of a wheeled food container 302. In an embodiment, while the usual orientation of a wheeled food containers 300, 302 can be different from an article of luggage, the structure and components can be substantially the same as shown in FIG. 1A. In an embodiment, the wheeled food container 300 can use four wheels 316 rather than two wheels 316 for luggage. A handle 318 may pivot relative to the container body 110. Openable surface 312*c*, e.g., a lid, may be secured to container body 310 using latches or similar devices rather than a zipper.

The container body 310 includes exterior surfaces 312*a* and 312*c*. A strap mechanism 320 includes a retractable strap 322. The retractable strap 322 retains an item 324. An extended end 328 of the retractable strap 322 is preferably be configured to be secured to a fastening device 326. A strap locking mechanism 330 can be located as part of the strap mechanism 320. In an embodiment a retractable strap 322 can include a tensioning mechanism 332.

Figure 3D:
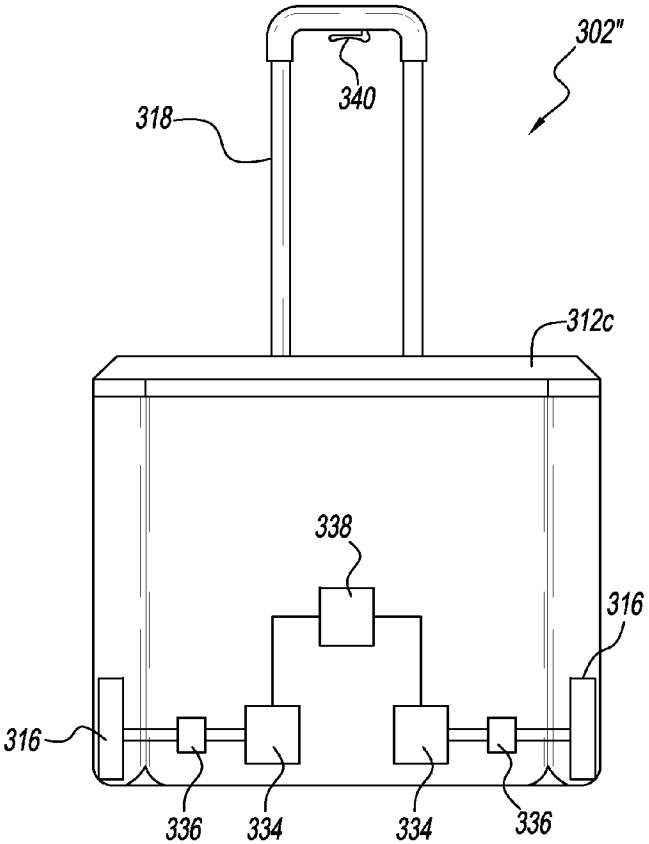
FIG. 3D is a front view of a second embodiment of a movable container system configured as a wheeled food cooler having two motor drives.
Figure 3C:
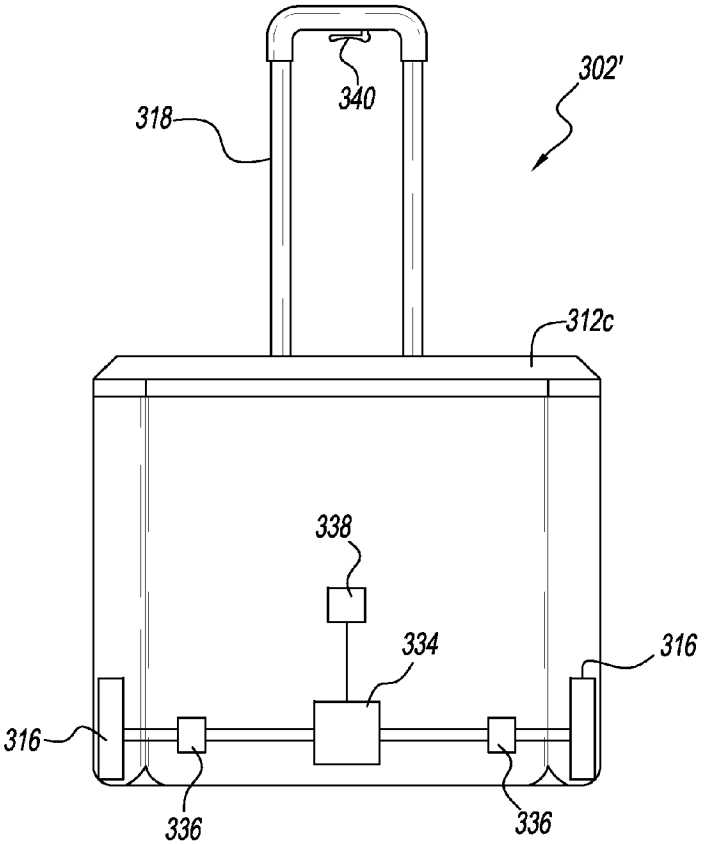
FIG. 3C is a front view of a second embodiment of a movable container system configured as a wheeled food cooler having a single motor drive.

With reference to FIG. 3C, a motorized wheeled food container 302' includes the container 310, the handle 318, a motor 334, two clutches 336, a battery 338 and a motor controller 340. The motor 334, the two clutches 336 and the battery 338 are preferably located in the container 310. The motor controller is preferably located in the handle 318. The motor 334 drives the two wheels 316 through the two clutches 336. The battery 338 supplies the motor 334 with electrical power. With reference to FIG. 3D, a motorized wheeled food container 302" includes the container 310, the handle 318, two motors 334, two clutches 336, the battery 338 and the motor controller 340. Each wheel 316 is driven by a single motor 334 through the clutch 336. The battery 338 supplies the two motors 334 with electrical power. The motor controller 340 controls the at least one motor 334. The motorized wheeled food containers 302', 302" can also use a different source of power. For example, in an embodiment, an internal combustion engine can be used to supply power to the wheels.

Figure 4A:
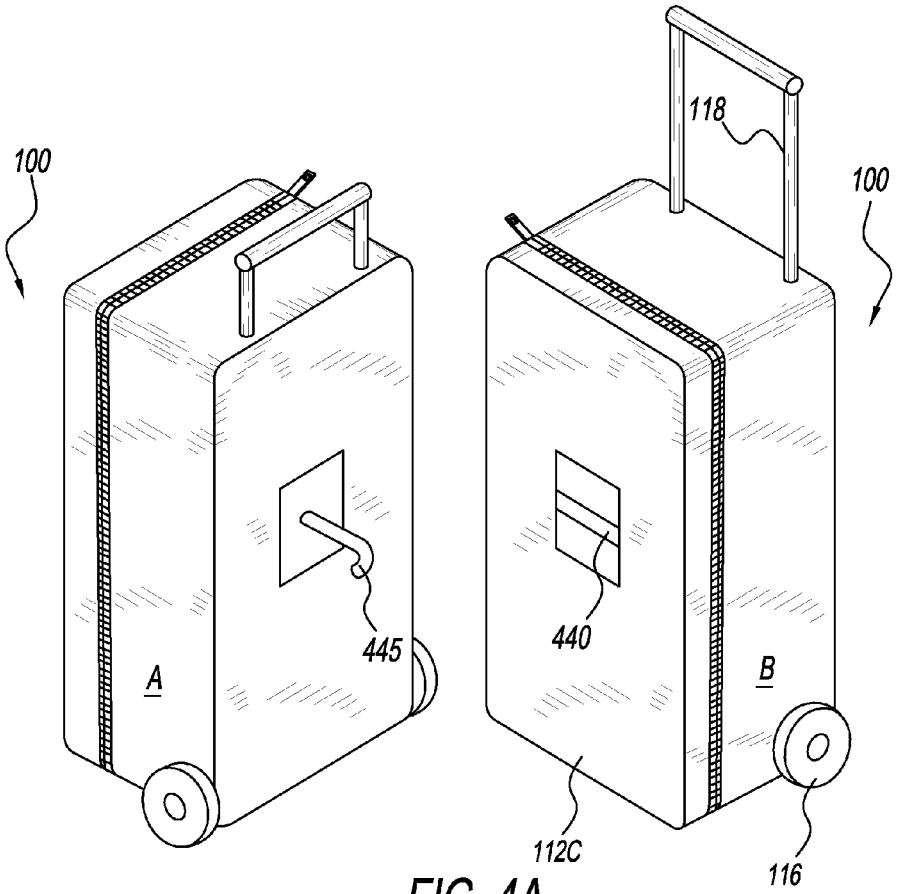
FIG. 4A is a perspective view of a first movable container system with a hook and a second movable container system with a bar for releasable attachment to each other.
Figure 4B:
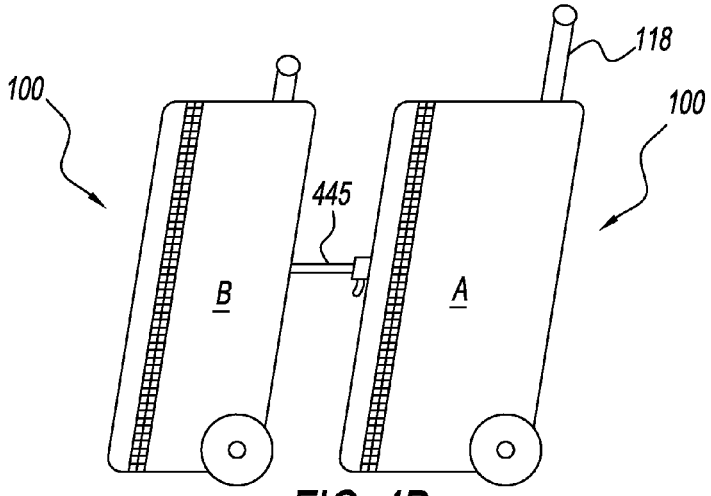
FIG. 4B is a perspective view of a first movable container system attached to a second movable container system.

With reference to FIGS. 4A-4B, provisions can be made such that one movable container system 100 can be releasably attached to one or more other movable container systems. For example, container system "A" could have on the exterior surface (FIG. 1, 112*c*) a recessed slide bar, slide buckle, or a hook and loop fastener system, e.g., VELCRO, which can be hooked or buckled to "B." "B" can have a hook or buckle insert or hook and loop fastener system, e.g. VELCRO. Once hooked, the retractable handle of "A" can be extended, but the handle of "B" is not required to be extended. "A" can be tilted forward to pull both "A" and "B" by the bottom back wheels of "A" and "B" (116). Without a fixed slide bar on "A," the tilt could lift "B," which may not be the desired effect. However, with the slide bar, when "A" is tiled forward, the bar could slide down, allowing "B" to remain on the ground and be pulled, connected to "A," but being supported by its two back wheels. The slide bar could be long enough to accommodate the tilt and still allow the wheels on "B" to remain on the ground. In an embodiment, an approximately 3 to 6 inch range can be allowed to achieve this effect.

Figure 4C:
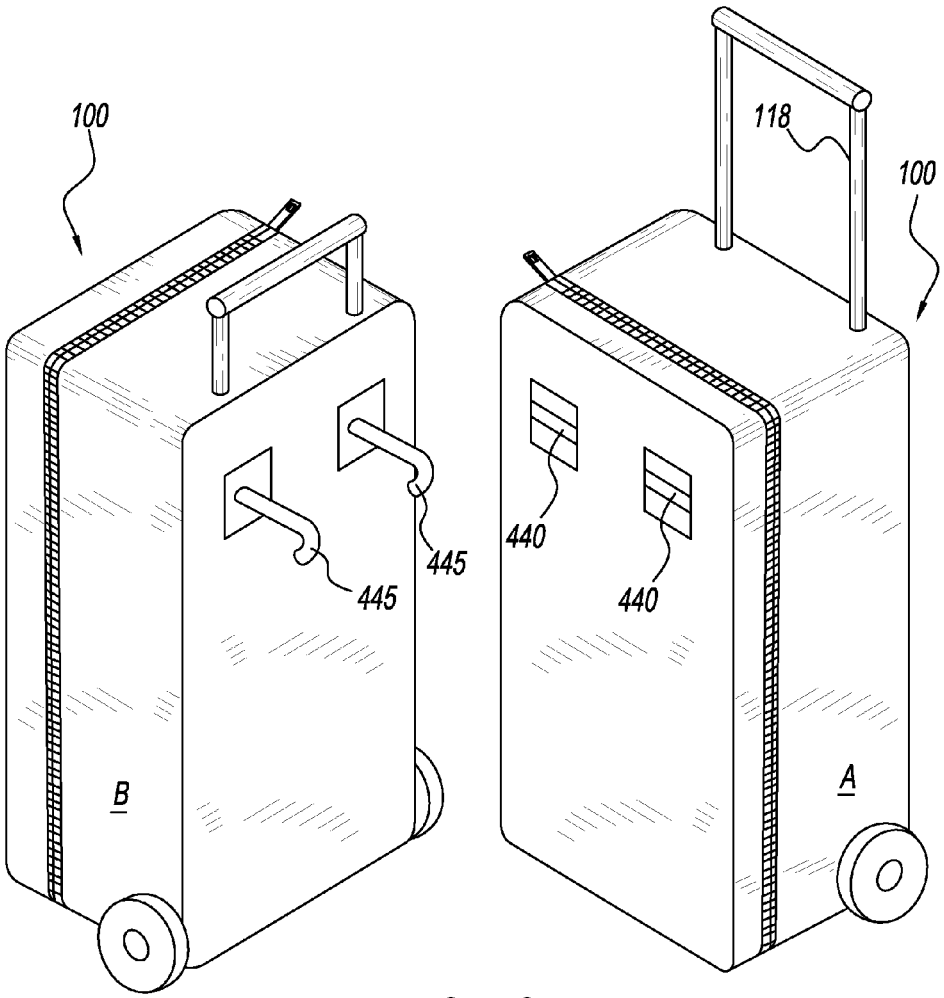
FIG. 4C is a perspective view of a first movable container system with two hooks and a second movable container system with two bars for releasable attachment to each other.

In an embodiment, the bar 440 could be located on an exterior wall surface of the container 100 ("A"), which holds the retractable handle 118. It could be in a corresponding position to the hook 445 on the container 100 ("B") bar 440, so that when "A" and "B" are placed together, the hook 445 grasps the bar 440. The number of bars 440 and hooks 445 may be doubled as shown in FIG. 4C.

In an embodiment, the bar and hook or buckle and insert could be placed on the exterior walls singularly in the middle, dually on top, middle or lower section or top and bottom; the number could be determined by the weight, strength and requirements of what is intended or considered to be pulled. "B" could have an exterior strap with connecting hook or buckle insert, hinged or attached hook or buckle insert, arm with same or coil strap with lock and tension tightening device or other configurations as required.

In an embodiment, an interior support bar or structure could be provided to accommodate and support the extra weight of "B" being pulled.

In an embodiment, the bar, hook 445 or buckle and insert system could also be independently produced as a separate unit to be attached to two pieces of luggage not pre-configured with the system. For example, a paper peel-off type industrial adhesive could be attached to the back of the components, i.e., hook and slide bar unit or buckle and buckle inset or hook and loop fastener system, e.g., VELCRO to allow for exterior placement of the components on the luggage. Other suitable attachment methods can also be used.

These embodiments could also be included with coolers, duffle bags, backpacks, book bags or the like, in motorized and non-motorized versions.

Figure 4D:
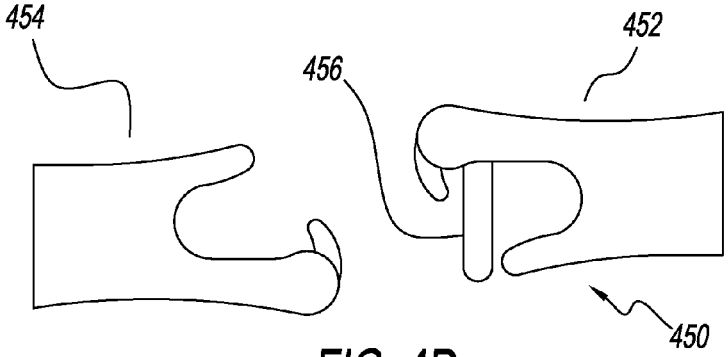
FIG. 4D is a side view of a first coupler and a second coupler for joining a first movable container system to a second movable container system.

With reference to FIG. 4D, the bar 440 and hook 445, may be replaced with a coupler arrangement 450. The coupler arrangement 450 provides releasably attachment of two movable container systems 100. The coupler arrangement 450 includes a first coupler member 452 and a second coupler member 454. The coupler arrangement 450 is similar in principle to the devices that connect railroad cars to each other. In an embodiment, units "A" and "B" can stay in a generally level orientation and the arms of the coupling devices could lock as "A" and "B" are pulled. In an embodiment, an unlocking mechanism, such as a lever 456, on the first coupler member 452 can be used to allow the two movable container systems 100 to be disconnected.

Figure 4E:
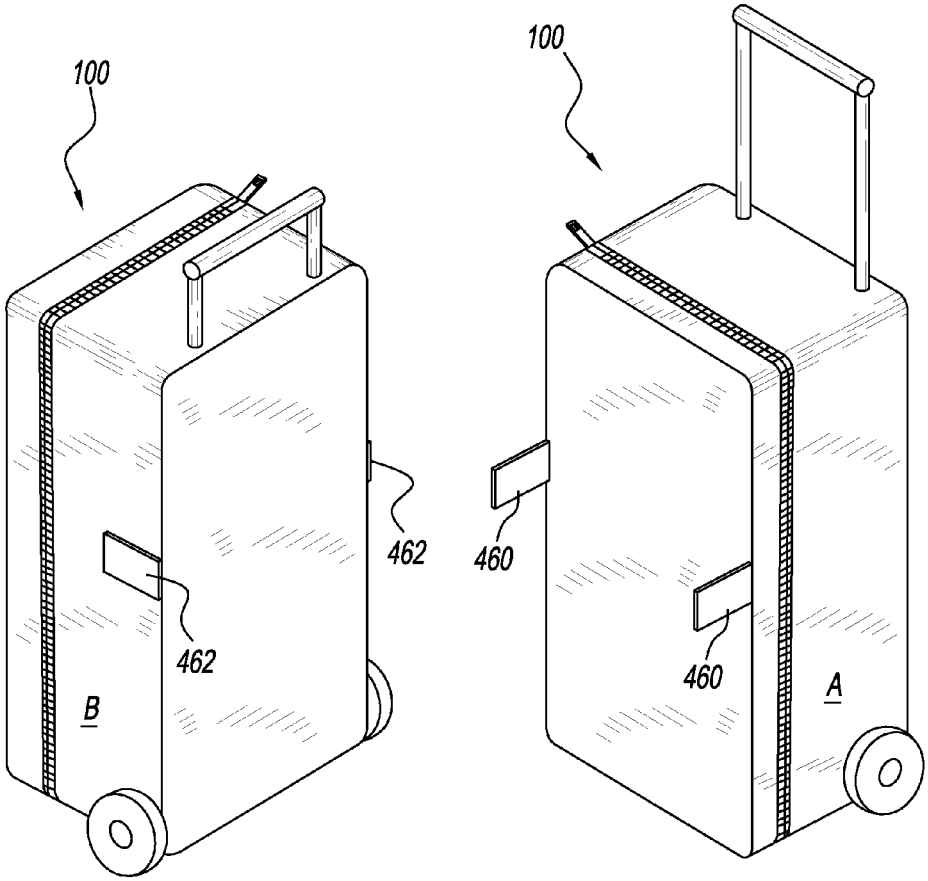
FIG. 4E is a perspective view of a first movable container system with a first pair of hook and loop fastener pads and a second movable container system with a second pair of mating hook and loop fastener pads.

With reference to FIG. 4E, units "A" and "B" can be releasably attached using, for example, a hook and loop fastener system, such as VELCRO of suitable characteristics. A first set of hook and loop fastener straps 460 are secured to opposing sides of the movable container system 100 ("A"). A second set of hook and loop fastener pads 462 are secured to opposing sides of the movable container system 100 ("B"). When desired to releasably attach two or more movable container systems 100, the straps 460 from movable container system 100 ("A") can be extended and attached to the fastener pads 462 of another movable container system 100 ("B").

Figure 4F:
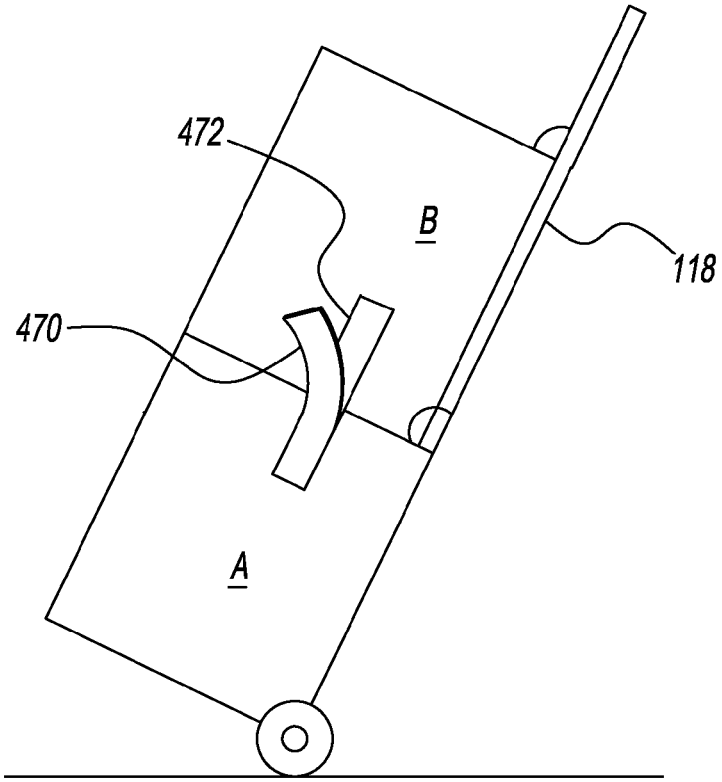
FIG. 4F is a side view of a first movable container system with a first pair of hook and loop fastener pads stacked on top of a second movable container system with a second pair of mating hook and loop fastener pads, before the first and second pairs of hook and loop fasteners pads are secured to each other.

With reference to FIG. 4F, a first movable container system 100 ("A") includes a pair of hook and loop straps 470 extending from opposing sides of the first movable container system 100 ("A") at a top thereof. A second movable container system 100 ("B") includes a pair of hook and loop pads 472 secured to opposing sides of the second movable container system 100 ("B"). The second movable container system 100 ("B") is stacked on top of the first movable container system 100 ("A"). The pair of hook and loop straps 470 are secured to the pair of hook and loop pads 472 to secure the first and second movable container systems to each other.

Figure 4G:
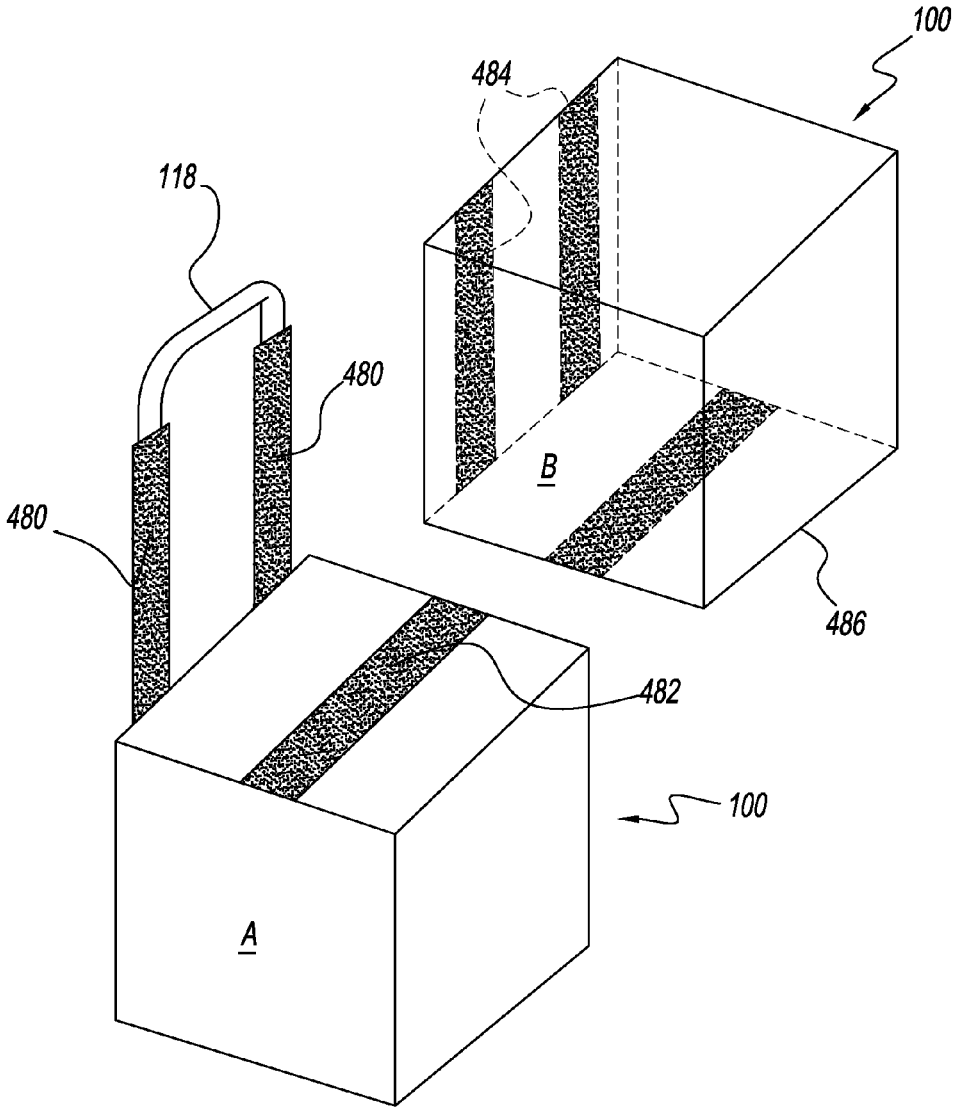
FIG. 4G is an exploded perspective view of a first movable container system with a first set of hook and loop fastener pads located on a handle and a top thereof, adjacent a second movable container system with a second set of mating hook and loop fastener pads located on a back and bottom thereof.

With reference to FIG. 4G, a first movable container system 100 ("A") includes a pair of handle hook and loop pads 480 attached to the handle 118 and a top hook 482 attached to a top surface of the first movable container system 100 ("A"). A second movable container system 100 ("B") includes a pair of hook and loop pads 484 secured to a rear and a hook and loop pad 486 secured to a bottom thereof. The second movable container system 100 ("B") is stacked on top of the first movable container system 100 ("A"). The pair of handle hook and loop straps 480 are secured to the pair of hook and loop pads 484 and the bottom hook and loop pad 486 is secured to the top hook and loop pad 482 to secure the first and second movable container systems to each other.

Figure 4H:
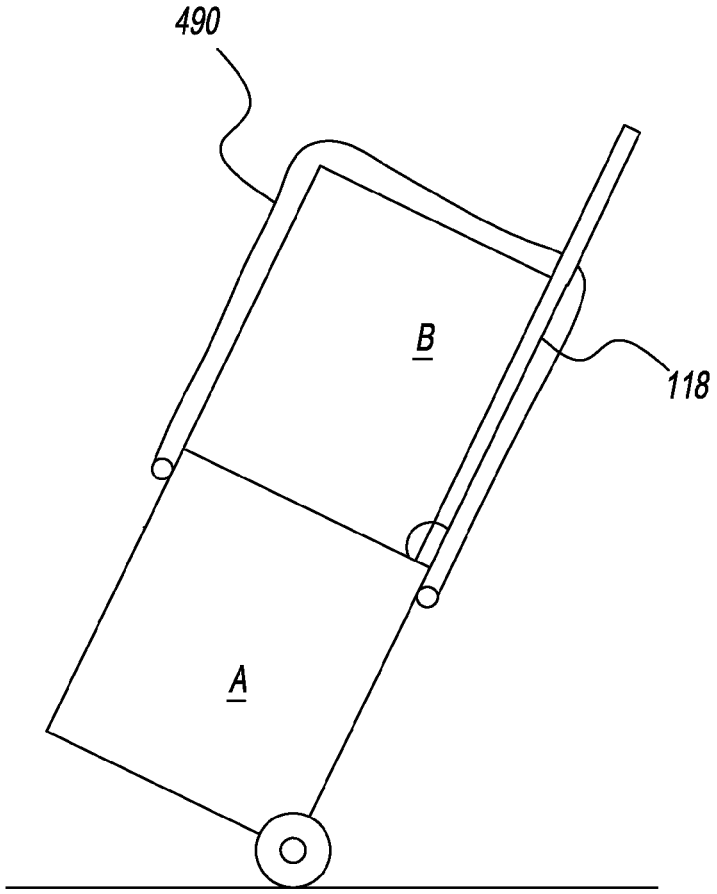
FIG. 4H is a side view of a first movable container system retained on a second movable container system with a retractable strap.

With reference FIG. 4H, at least one retractable strap 490 is used to secure the second movable container system 100 ("B") to the first movable container system 100 ("A"). The retractable strap 490 is similar to retractable strap 122. However, the retractable strap 490 extends from the front and back, or top of the first movable container system 100 ("A").

In an embodiment, the container systems described herein can be attached or stacked in various horizontal and vertical configurations, which can be pulled or pushed using their handles. In an embodiment, each container system can contribute a part of a handle for a system of releasably attached container systems. For example, a portion of a handle from "A" can be connected to a portion of a handle from "B" to form a single handle. In an embodiment, a slidable locking device can be used to securely hold the two handle portions together.

Figure 4I:
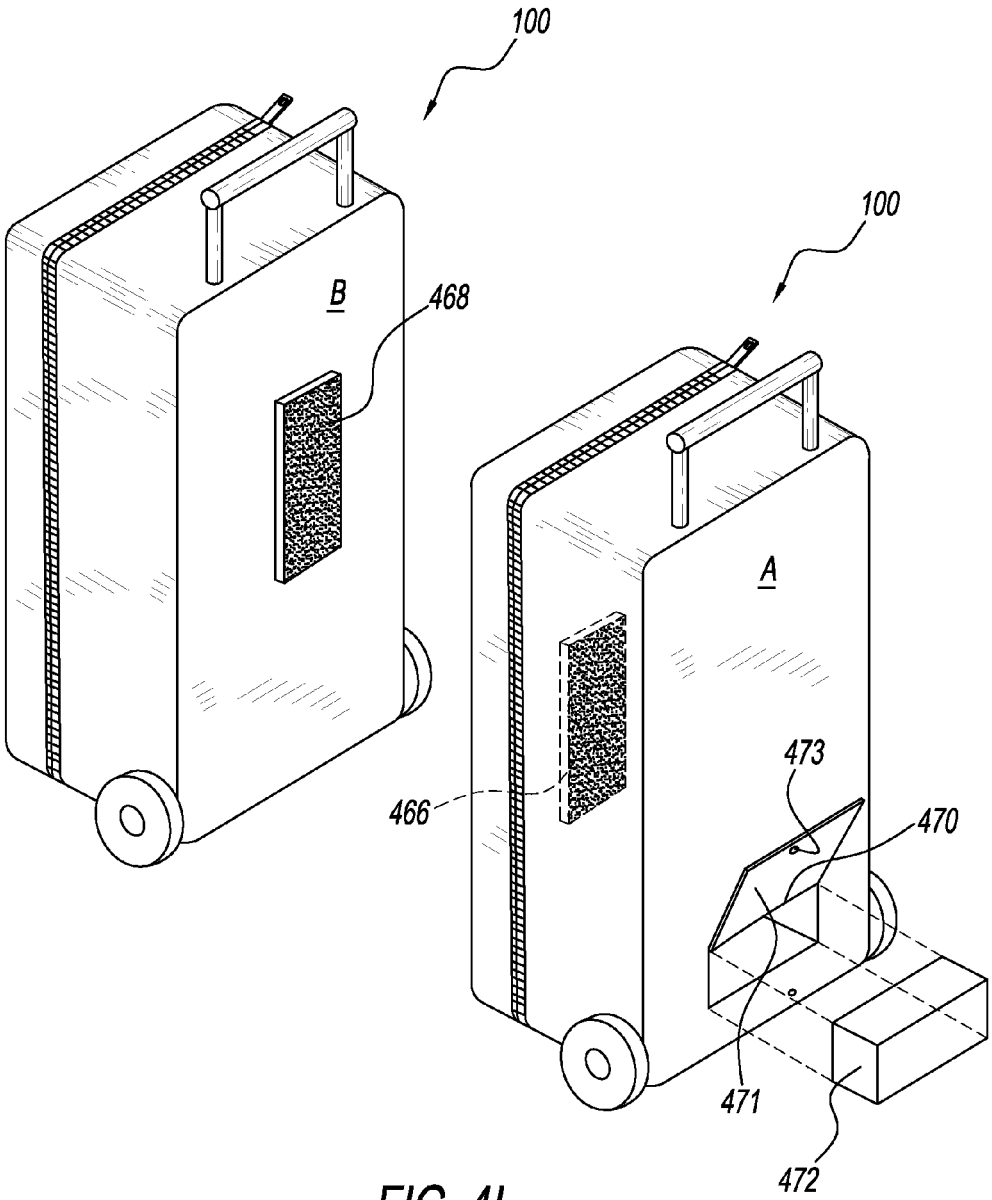
FIG. 4I is an exploded perspective view of a first movable container system with a first set of hook and loop fastener pads located on a front thereof, adjacent a second movable container system with a second set of mating hook and loop fastener pads located on a back thereof, the first movable container system includes a pocket for receiving a battery.

With reference to FIG. 4I, units "A" and "B" can be releasably attached using, for example, a hook and loop fastener system, such as VELCRO of suitable characteristics. A first hook and loop fastener pad 466 is secured to a front of the movable container system 100 ("A"). A second hook and loop fastener pad 468 is secured to a back of the movable container system 100 ("B"). When it is desired to releasably attach the two movable container systems 100, the movable container systems ("A") and ("B") are pushed together. A battery pocket 470 is formed in a bottom of the movable container system ("A") to receive and retain a battery 472. The battery pocket 470 may have any suitable length, height and depth. The battery pocket 470 is preferably covered with a door 471. The door 471 is preferably pivotally retained above the battery pocket 470 and secured to the movable container system 100 with a latch 473.

Figure 4J:
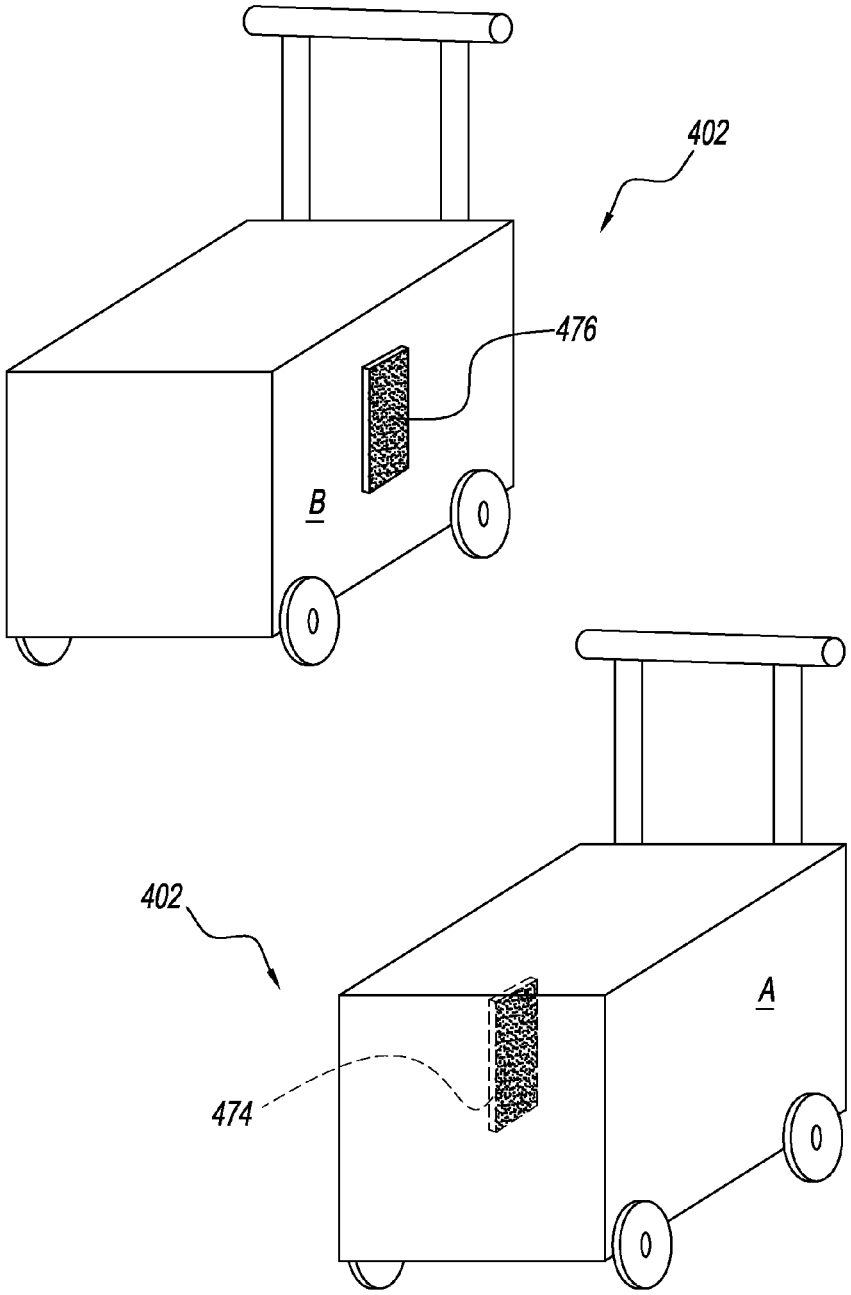
FIG. 4J is an exploded perspective view of a first movable container system with a first set of hook and loop fastener pads located on a side thereof, adjacent a second movable container system with a second set of mating hook and loop fastener pads located on an opposite side thereof.
Figure 4K:
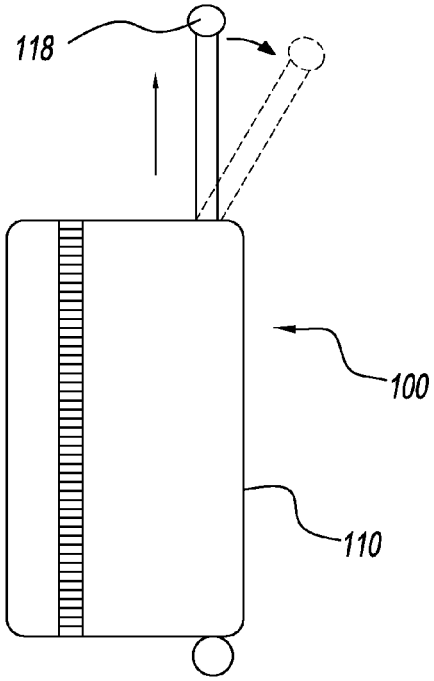
FIG. 4K is a side view of a movable container system with a handle that slides upward and pivots.

With reference to FIG. 4J, units "A" and "B" can be releasably attached using, for example, a hook and loop fastener system, such as VELCRO of suitable characteristics. A first hook and loop fastener pad 474 is secured to a side of a movable container system 402 ("A"). A second hook and loop fastener pad 476 is secured to an opposing side of a second movable container system 402 ("B"). When it is desired to releasably attach the two movable container systems 402, the movable container systems ("A") and ("B") are pushed together. With reference to FIG. 4K, the movable container system 100 includes the handle 118 that slides and pivots relative to the container body 110.

Figure 4L:
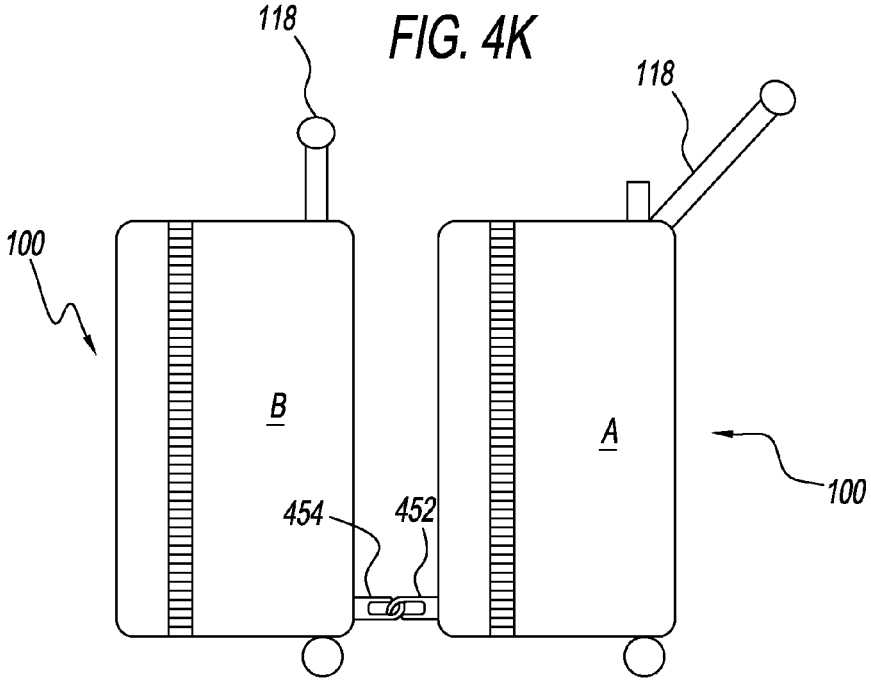
FIG. 4L is a side view of a first movable container system connected to a second movable container system with a first and second coupler shown in FIG. 4D.

With reference to FIG. 4L, units "A" and "B" can be releasably attached to each other using the first coupler 450 and the second coupler 454. The first coupler 450 extends from a bottom of the first movable container system 100 ("A") and the second coupler extends from a bottom of the second movable container system 100 ("B").

Figure 5A:
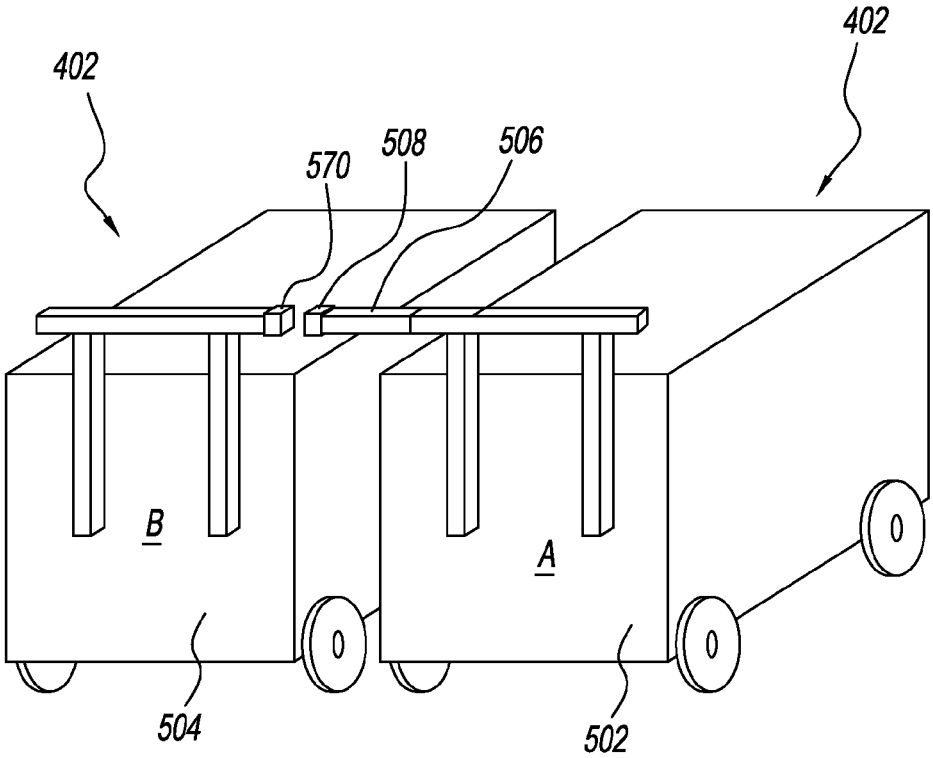
FIG. 5A is a perspective view of a first movable container system having a first handle for connection to a second handle of a second movable container system.

With reference to FIG. 5A, a first movable container system 402 includes a first connecting handle 502. The second movable container systems 402 ("B") includes a second connecting handle 504. The first connecting handle 502 includes a telescoping connector 506. The telescoping connector 506 includes a first connecting pad 508. The second connecting handle includes a second connecting pad 510. The first and second connecting pads 508, 510 are secured to each other to move the first and second movable container systems 402 in tandem. Each connecting pad 508, 510 may be any suitable interlocking connector.

Figure 5B:
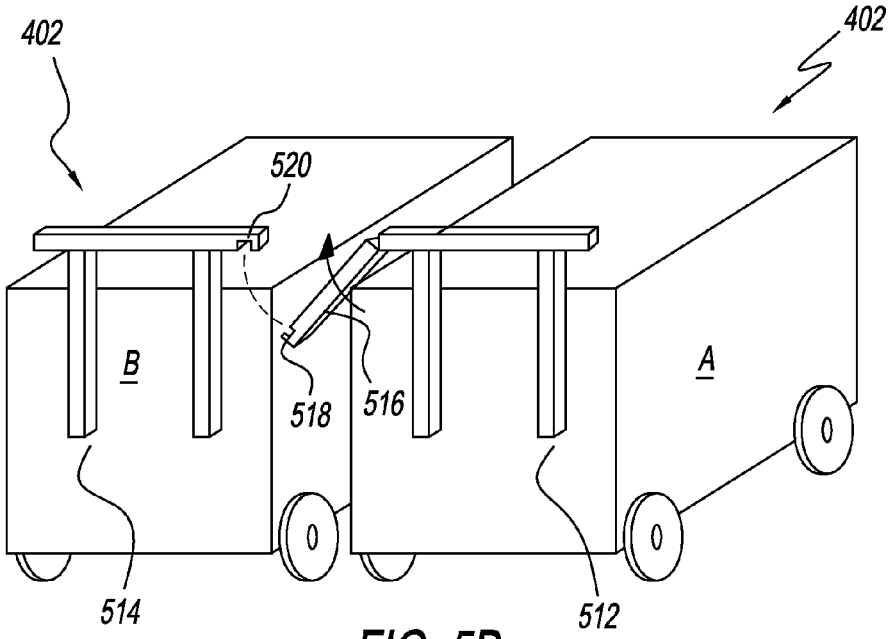
FIG. 5B is a perspective view of a first movable container system having a first handle with a downward swinging bar for connection to a second handle of a second movable container system.

With reference to FIG. 5B, a first movable container system 402 includes a first connecting handle 512. The second movable container system 402 ("B") includes a second connecting handle 514. The first connecting handle 512 includes a swinging bar 516, which is pivotally retained on an end of the first connecting handle 512. The swinging bar 516 is terminated with a notch projection 518. The second connecting handle 514 includes a downward facing notch 520. The downward facing notch 520 is sized to receive the notch projection 518. However, other means of connecting the swinging bar 516 to the second connecting handle 514 may also be used, such that the first and second movable container systems 402 may be moved in tandem.

Figure 5C:
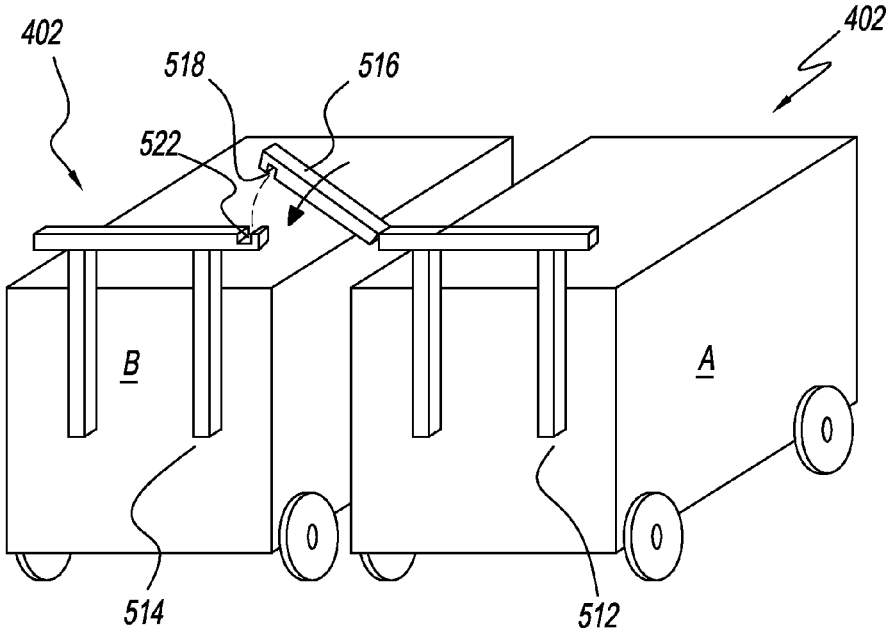
FIG. 5C is a perspective view of a first movable container system having a first handle with an upward swinging bar for connection to a second handle of a second movable container system.

With reference to FIG. 5C, a first movable container system 402 includes a first connecting handle 512. The second movable container system 402 ("B") includes a second connecting handle 514. The first connecting handle 512 includes a swinging bar 516, which is pivotally retained on an end of the first connecting handle 512. The swinging bar 516 is terminated with a notch projection 518. The second connecting handle 514 includes an upward facing notch 522. The downward facing notch 522 is sized to receive the notch projection 518. However, other means of connecting the swinging bar 516 to the second connecting handle 514 may also be used, such that the first and second movable container systems 402 may be moved in tandem.

The above description is presented to enable a person skilled in the art to make and use the systems and methods described herein, and is provided in the context of a particular application and its requirements. Various modifications to the embodiments will be readily apparent to those skilled in the art, and generic principles defined herein may be applied to other embodiments and applications without departing from the spirit and scope of the claims. Thus, there is no intention to be limited to the embodiments shown, but rather to be accorded the widest scope consistent with file principles and features disclosed herein.

I claim:

1. A movable container system comprising:

a container system includes a container body and a container lid, said container body includes a rear surface, two side surfaces, a top surface and a bottom surface, said container lid is retained on a front perimeter of said container body, a storage cavity is created inside said container body;

a closure device for removable attachment of said container lid to said front perimeter of said container body, said container lid provides access to said storage cavity;

at least one wheel is pivotally retained on opposing sides of said body container at a bottom of said two side surfaces and adjacent said rear surface;

a retractable handle is located adjacent said top surface and said rear surface of said container body, said retractable handle extends and retracts relative to said top surface;

at least one strap system includes a spring retracted reel and a strap, said spring retracted reel is retained inside said storage cavity, one end of said strap is attached to said spring retracted reel and an opposing end of said strap extends through a slit in one end of said top surface, said opposing end of said strap is located adjacent said retractable handle; and at least one fastening device is retained on said top surface on an opposing end of said top surface, said opposing end of said strap is removable attachable to one of said at least one fastening device, wherein said strap exerting pressure on an item when said opposing end of said strap is secured to one of said at least one fastening device, said container lid may be completely opened and provide full access to said storage cavity when the item is secured to said top surface with said strap.

2. The movable container system of claim 1 wherein:
said fastening device is one of an open hook, a hook having a depressible closure, a hook having a retractable closure, an extended end with a loop, a buckle, a loop and a bar.

3. The movable container system of claim 1 wherein:
said retractable handle is a telescoping handle.

4. The movable container system of claim 1 wherein:
a locking mechanism for locking said strap at a desired length, said locking mechanism is located on said top surface.

5. The movable container system of claim 1 wherein:
said closure device is a zipper.

6. The movable container system of claim 1 wherein:
said strap includes at least two parallel strap members.

7. The movable container system of claim 1 wherein:
said strap includes two crossing strap members.

8. A movable container system comprising:
a container system includes a container body and a container lid, said container body includes a rear surface, two side surfaces, a top surface and a bottom surface, said container lid is retained on a front perimeter of said container body, a storage cavity is created inside said container body;
a closure device for removable attachment of said container lid to said front perimeter of said container body, said container lid provides access to said storage cavity;
at least one wheel is pivotally retained on opposing sides of said body container at a bottom of said two side surfaces and adjacent said rear surface;
a retractable handle is located adjacent said top surface and said rear surface of said container body, said retractable handle extends and retracts relative to said top surface;
at least one strap system includes a spring retracted reel and a strap, said spring retracted reel is retained inside said storage cavity, one end of said strap is attached to said spring retracted reel and an opposing end of said strap extends through a slit in one end of said top surface; and
at least one fastening device is retained on said top surface on an opposing end of said top surface, said opposing end of said strap is removable attachable to one of said at least one fastening device, wherein said strap exerting pressure on an item when said opposing end of said strap is secured to one of said at least one fastening device, said container lid may be completely opened and provide full access to said storage cavity when the item is secured to said top surface with said strap.

9. The movable container system of claim 8 wherein:
said fastening device is one of an open hook, a hook having a depressible closure, a hook having a retractable closure, an extended end with a loop, a buckle, a loop and a bar.

10. The movable container system of claim 8 wherein:
said retractable handle is a telescoping handle.

11. The movable container system of claim 8 wherein:
a locking mechanism for locking said strap at a desired length, said locking mechanism is located on said top surface.

12. The movable container system of claim 8 wherein:
said closure device is a zipper.

13. A movable container system comprising:
a container system includes a container body and a container lid, said container body includes a rear surface, two side surfaces, a top surface and a bottom surface, said container lid is retained on a front perimeter of said container body, a storage cavity is created inside said container body;
a closure device for removable attachment of said container lid to said front perimeter of said container body, said container lid provides access to said storage cavity;
at least one wheel is pivotally retained on opposing sides of said body container at a bottom of said two side surfaces and adjacent said rear surface;
a retractable handle is located adjacent said top surface and said rear surface of said container body, said retractable handle extends and retracts relative to said top surface;
at least one strap system includes a spring retracted reel and a strap, said spring retracted reel is retained inside said storage cavity, one end of said strap is attached to said spring retracted reel and an opposing end of said strap extends through a slit in one end of said top surface, said strap includes one of at least two parallel strap members and two crossing strap members; and
at least one fastening device is retained on said top surface on an opposing end of said top surface, said opposing end of said strap is removable attachable to one of said at least one fastening device, wherein said strap exerting pressure on an item when said opposing end of said strap is secured to one of said at least one fastening device, said container lid may be completely opened and provide full access to said storage cavity when the item is secured to said top surface with said strap.

14. The movable container system of claim 13 wherein:
said fastening device is one of an open hook, a hook having a depressible closure, a hook having a retractable closure, an extended end with a loop, a buckle, a loop and a bar.

15. The movable container system of claim 13 wherein:
said retractable handle is a telescoping handle.

16. The movable container system of claim 13 wherein:
a locking mechanism for locking said strap at a desired length, said locking mechanism is located on said top surface.

17. The movable container system of claim 13 wherein:
said closure device is a zipper.

* * * * *